US005937919A

United States Patent [19]

Zavos et al.

[11] Patent Number: 5,937,919

[45] Date of Patent: Aug. 17, 1999

[54] FLUID LAYERING APPARATUS

[76] Inventors: Panayiotis M. Zavos; Panayota N. Zarmakoupis-Zavos, both of 2413 Vince Rd., Nicholasville, Ky. 40356

[21] Appl. No.: 09/044,577

[22] Filed: Mar. 19, 1998

[51] Int. Cl.[6] ..... B67C 11/00

[52] U.S. Cl. ..... 141/100; 141/333; 141/364; 141/366

[58] Field of Search ..... 141/9, 100, 333, 141/334, 364, 366, 375, 383, 386, 392; 222/129.3, 129.4, 566

[56] References Cited

U.S. PATENT DOCUMENTS

| | | | |
|---|---|---|---|
| 654,879 | 7/1900 | Dineen | 141/100 |
| 1,445,339 | 2/1923 | Mathews | 141/392 |
| 2,333,036 | 10/1943 | Orndorff | 141/392 |
| 2,740,571 | 4/1956 | Busto | 141/94 |
| 3,256,916 | 6/1966 | Siletti | 141/100 |
| 3,534,788 | 10/1970 | Vergobbi et al. | 141/392 |
| 3,599,681 | 8/1971 | Hall | 141/383 |
| 3,756,290 | 9/1973 | Cleland et al. | 141/392 |
| 3,811,483 | 5/1974 | Morrison | 141/392 |
| 3,814,147 | 6/1974 | Lindberg | 141/392 |
| 3,921,685 | 11/1975 | Steffes | 141/392 |
| 4,126,164 | 11/1978 | Magnifico | 141/100 |
| 4,269,236 | 5/1981 | Fogg | 141/392 |
| 4,800,934 | 1/1989 | Boissoneault | 141/333 |
| 5,526,853 | 6/1996 | McPhee et al. | 141/383 |
| 5,609,189 | 3/1997 | Sternheimer et al. | 141/364 |

*Primary Examiner*—J. Casimer Jacyna
*Attorney, Agent, or Firm*—Don Halgren

[57] ABSTRACT

The present invention comprises a layering apparatus for the disposition of multiple fluids in sequence, into a receptacle, in a series of separate layers. The apparatus includes a tubular shaped column having an open upper end and a lower end having a base plate arranged thereacross. The base plate is arranged at an angle of between about 35° to 60° with respect to the longitudinal axis of the column. An annular flange is arranged about the upper end of the column to permit the column to be supported by an upper edge of a receptacle in which the column is disposed. An opening is arranged in the column adjacent the base plate, to permit the even, controlled drainage of fluid into a receptacle after receipt of that fluid in the upper end of the column.

10 Claims, 2 Drawing Sheets

FLUID LAYERING APPARATUS

BACKGROUND OF THE INVENTION

1. Field of the Invention

This invention relates to an apparatus and method for the disposition of fluid materials into discreet layers within a container, such layers being useful for medical purposes.

2. Prior Art

In the scientific and medical community, examination, analysis and utilization of certain types of fluid materials, may sometimes require that they be layered. Such materials may be comprised of a media, chemical buffers, solutions, and other fluids of other colloidal, viscosity and concentration properties on top of one another in a multi-layer or mono-layer arrangement. The prior art includes layering of solutions utilizing manual or automated pipetting procedures. Such procedures may utilize solutions in these pipettes, syringes, syringes with needles, or other apparatus, to generate layered samples, for use in various in-vitro laboratory or clinical procedures.

These prior art methods are relatively complex, tedious, inefficient, time consuming and experimentally improper. These prior art methods of layering are also susceptible to technician error and laboratory-to-laboratory variations, as well as to accidents. Also, none of these prior art techniques of layering, allow the placement or layering of the materials or solutions with any degree of ease, with any degree of extreme repeatability, or accuracy in all likelihood, due to their typically manual operation and their extremely high labor intensity.

It is an object of the present invention, to overcome the disadvantages of the error prone prior art.

It is a further object of the present invention, to provide a layering apparatus, which may be readily controlled, and is subject to repeatability of the procedure.

BRIEF SUMMARY OF THE INVENTION

The present invention relates to a device and a method for the layering of materials such as media, chemical buffers, solutions and fluids having various colloidal, viscosity, and concentration properties in a multi-layer or mono-layer compartment arrangement, typically done in a laboratory setting. A preferred embodiment of the layering apparatus comprises a generally cylindrically or tubular shaped column having a first or lower end, and a second or upper end. The column, in its preferred embodiment, is circular in cross-sectional representation. The second or upper end of the column is generally open to the environment, and has an annular flange disposed therearound.

The first or lower end of the column has a sealed bottom. The sealed bottom comprises a planar member disposed across the column, the planar member lying in a plane arranged at an angle of between about 35° to 75° with respect to the longitudinal axis of the column. The periphery of the angularly disposed planar member on the bottom of the column defines an "oval" shape.

The column is defined by an annular wall. The lowermost end of the wall, at its lowermost juncture with the planar base member, has an opening thereat. The opening is through a portion of the wall surface, so as to form a curvilinear cutout adjacent to the base member. The cutout in the lowermost portion of the wall of the column is of arcuate configuration, subtending an arc extending between about 20° and about 60° in range. The height or longitudinal dimension of the arcuate opening may extend from 2 mm to about 30 mm. A typical column may range in diameter from about 0.8 cm to about 5 cm in diameter. The longitudinal length of the column preferably extends in a range from about 8 cm to about 20 cm in length.

A further embodiment of the present layering apparatus, includes a column generally similar to the aforementioned preferred embodiment, having a pair of longitudinally directed ribs arranged radially inwardly on the inside surface of the wall of the column. Each longitudinally directed rib is disposed adjacent the end of the arcuate opening or cutout in the column wall. An arcuate panel, of generally similar radial configuration as the inside surface of the wall of the column, is longitudinally moveably arranged between the parallel ribs on the column wall. The curvilinear panel is arranged to provide a heightwise adjustment to the arcuate opening at the base of the column in the column wall. Longitudinal movement of the curvilinear panel will permit heightwise (longitudinally directed) adjustment in the arcuate opening to permit variation in the fluid flow rate as needed, depending upon viscosity, concentration, and other factors of the fluid being layered.

In operation of the present layering apparatus invention, the column is placed in a receptacle in which the fluids are to be received and layered. The annular rim at the upper end of the column provides an abutment by which the column may be placed on and rest within a test tube or open receptacle, thereby enabling the receipt of fluid therewithin. The fluid will flow through the arcuate opening or aperture at the base of the column, and will be caused by its momentum, to strike the side of the receptacle in which the column is placed, so as to permit a smooth layer to be placed within the receptacle by the fluid running down the inner side wall of that receptacle in a controlled manner.

Subsequent layers of subsequent fluids may be disposed within the receptacle by transfer through the column, where minimum momentum is provided to that fluid, by the dispersion of that across the planar bottom member and through the arcuate orifice and onto an arcuate broad path within the receptacle. Thus, the fluid is permitted to layer with minimum turbulence and minimum manual input, once the column has been given the desired size or charge of fluid. Further manual operation is not necessary.

The invention thus comprises a layering apparatus for the disposition of fluid into a layer into a receptacle in which the apparatus is placed. The apparatus comprises a cylindrically shaped column member having an outer wall, the column having a lower or first end and an open upper or second end. A base member is arranged across the first end, the base member being disposed at a skewed angle with respect to the longitudinal axis of the column. An opening is arranged through the wall of the column, at the juncture of the base member and the wall, to permit any fluid deposited in the upper end of the column to drain out the opening in the wall at the first end of the column in a controlled manner to permit layering of that fluid in the receptacle. The base member is of planar configuration, to provide a flat surface from which fluid deposited in the column may drain. The wall of said column is of arcuate configuration. The arcuate opening in said wall subtends an arc of from about 35° to about 75°. The column has an annular flange arranged about its upper end to permit the column to rest against the upper end of a receptacle during drainage of fluid from the column in the layering process.

The invention also includes a method of layering fluids in a receptacle, comprising the steps of: arranging an elongated cylindrically shaped wall to define a column; placing the column in an upper end of the receptacle, the column having an open upper end and a lower end, the lower end having a base member arranged thereacross; skewing the angle of the base member with respect to the longitudinal axis of the column; placing an opening through the wall of the column at the lower end thereof; and depositing a fluid to be layered in the receptacle, in the upper end of the column so as to permit the fluid to flow through the column, over the base member and out of the column through the opening, in a manner conducive to layering of fluid into the receptacle.

The method includes the steps of forming the base member to as to be planar, to allow any fluid deposited in the column to flow evenly thereacross and out through the opening in the wall of the column, providing a radially outwardly directed flange around the upper end of the column, to permit the flange to rest upon an upper edge of the receptacle during a layering procedure therein; forming the opening into an arcuate shape; changing the size of the opening by moving a curvilinear panel against the inner side of the wall, to change the dimension of the opening.

The invention includes a layering apparatus for the disposition of multiple fluids in sequence, into a receptacle, in a series of separate layers, said apparatus comprising: a tubular shaped column having an open upper end and a lower end having a base plate arranged thereacross, the base plate arranged at an angle of between about 35° to 60° with respect to the longitudinal axis of the column; an annular flange arranged about the upper end of the column to permit the column to be supported by an upper edge of a receptacle in which the column is disposed; and an opening arranged in the column adjacent the base plate, to permit the even, controlled drainage of fluid into a receptacle after receipt of that fluid in the upper end of the column. The opening is of arcuate configuration, to permit flow of fluid directly from the base plate into the receptacle.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1:
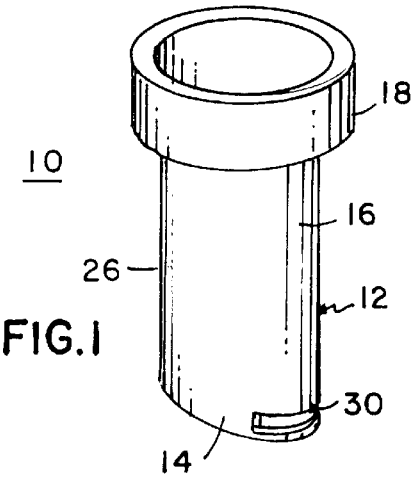
FIG. 1 is a view in perspective, of a column constructed according to the principles of the present invention.

Referring to the drawings in detail, and particularly to FIG. 1, there is shown a layering apparatus 10 for performing a method for the layering of materials such as media, chemical buffers, solutions and fluids having various colloidal, viscosity, and concentration properties in a multi-layer or mono-layer compartment arrangement, as need be done in a laboratory setting. A preferred embodiment of the layering apparatus 10 comprises a generally tubular shaped column 12 having a first or lower end 14, and a second or upper end 16. The column 12, in its preferred embodiment, is circular in cross-sectional representation, as may be seen in FIG. 1. The second or upper end 16 of the column 12, is generally open to the environment, and has an annular rim or flange 18 disposed therearound.

Figure 3:
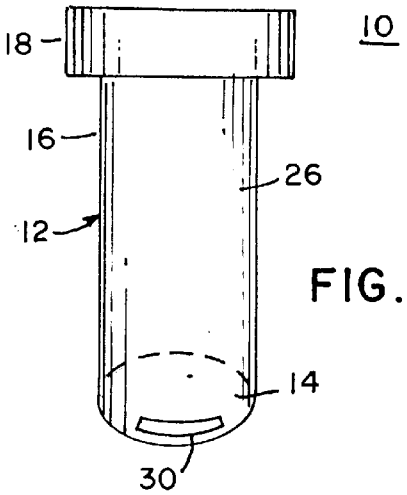
FIG. 3 is an elevational view of the front of a column, similar to that shown in FIG. 2.

The first or lower end 14 of the column 12 has a sealed bottom 20. The sealed bottom 20 comprises a planar member 22 disposed across the column 12, the planar member 22 lying in a plane arranged at an angle of between about 35° to 75° with respect to the longitudinal axis "L" of the column 12. The periphery of the angularly disposed planar member 22 on the bottom of the column 12 defines an "oval" shape, as may be visualized in FIG. 3.

Figure 2:
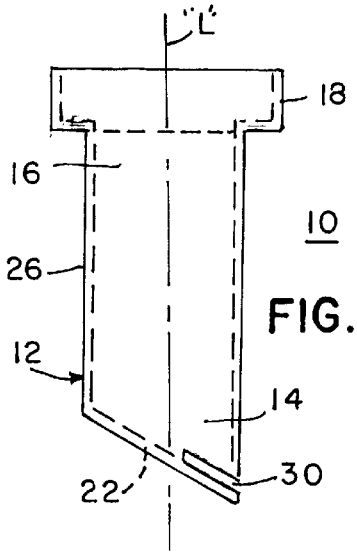
FIG. 2 is a side elevational view of a column, shown in FIG. 1.
Figure 4:
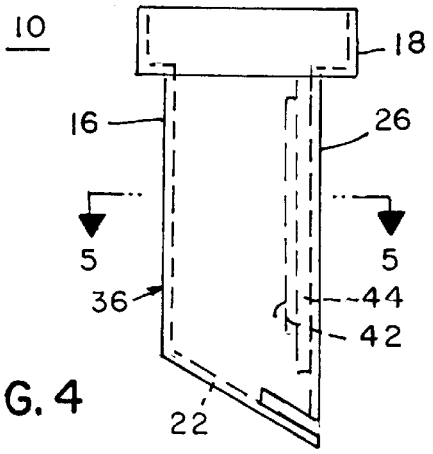
FIG. 4 is a side elevational view of a further embodiment of the column shown in FIG. 1.

The column 12 is defined by an annular wall 26. The lowermost end of the wall 26, at its lowermost juncture with the planar base member 22, has an opening 30 thereat. The opening 30 is through a portion of the surface of the wall 22 itself, so as to form a curvilinear cutout adjacent to the planar base member 22 as shown in FIGS. 2 & 4. The opening or cutout 30 in the lowermost portion of the wall 26 of the column 12 is of arcuate configuration, as may be seen in FIGS. 1 and 3, the opening 30 subtending an arc extending between about 20° and about 60° in range. The height or longitudinal dimension of the arcuate opening 30, may extend from 2 mm to about 30 mm. A typical column 12 may range in diameter from about 1 cm to about 5 cm in diameter. The longitudinal length of the column 12, preferably extends in a range from about 5 cm to about 20 cm in length.

Figure 5:
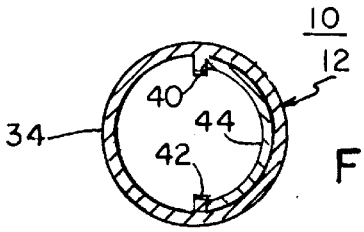
FIG. 5 is a view taken along the lines 5—5 of FIG. 4.

A further embodiment of the present layering apparatus 10, is shown in FIGS. 4 & 5, which includes a column 36, generally similar to the aforementioned preferred embodiment, having a pair of longitudinally directed ribs 40 and 42 arranged radially inwardly on the inside surface of the wall 34 of the column 36. Each longitudinally directed rib 40 and 42 is disposed adjacent the end of the arcuate opening or cutout 30 in the column wall 34. An arcuate panel 44, of generally similar radial configuration as the inside surface of the wall of the column 36, is longitudinally moveably arranged between the parallel ribs 40 and 42 on the radially inwardly directed side of the column wall 34. The curvilinear panel 44 is arranged to provide a heightwise adjustment to the arcuate opening 30 at the base of the column 36 in the column wall 34. Longitudinal movement of the curvilinear panel 44 will permit heightwise (longitudinally directed) adjustment in the arcuate opening 30, to permit variation in the fluid flow rate as needed, depending upon viscosity, concentration, and other factors of the fluid being layered.

Figure 6:
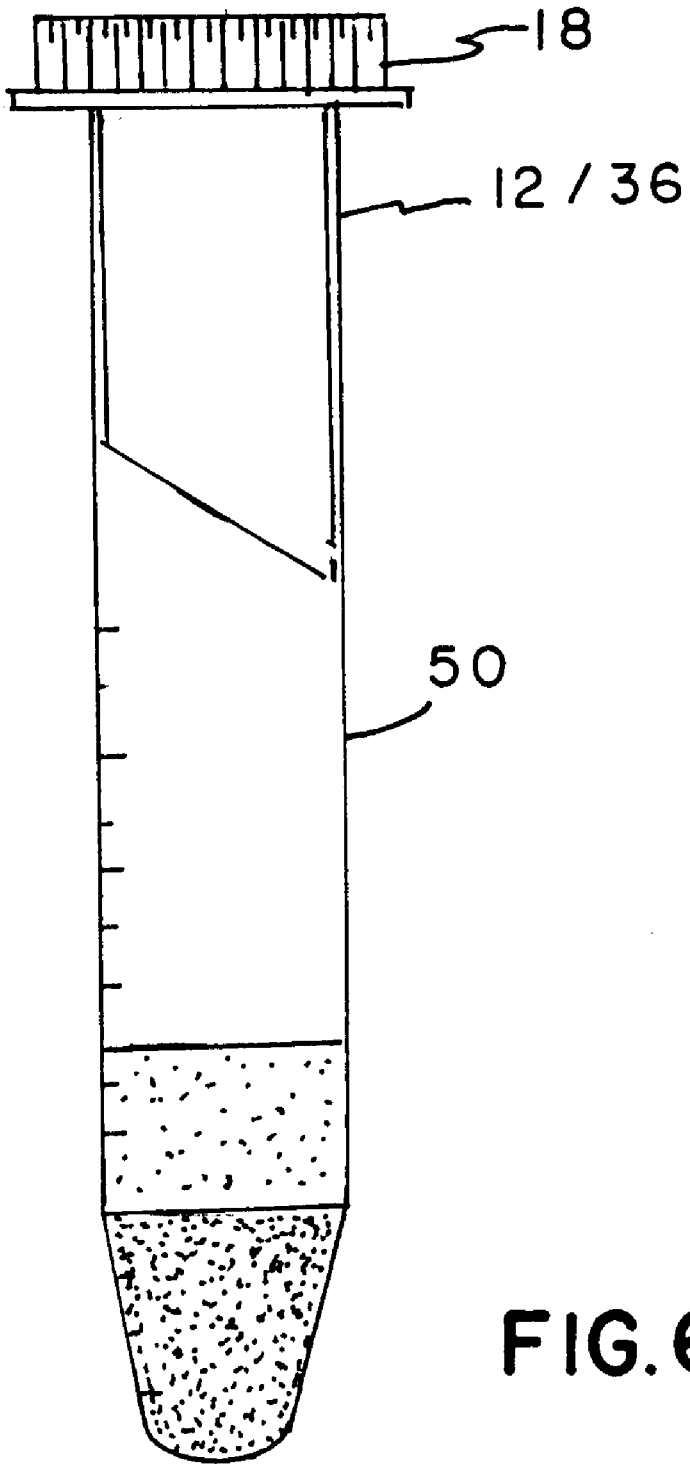
FIG. 6 is a view of the column of the present invention within a receptacle, several layers of fluid being shown therewithin.

In operation of the present layering apparatus 10, the column 12 or 36, is placed in a receptacle 50, as shown in FIG. 6 in which the fluids are to be received and layered. The annular rim 18 at the upper end of the column 12 or 36, provides an abutment by which the column 12 or 36 may be placed on and rest within a test tube or open receptacle 50, thereby enabling the drainage of fluid therethrough, and receipt of fluid within the intended receptacle 50. The fluid will flow through the arcuate opening or aperture 30 at the base of the column 12 or 36, and will be caused by its momentum, to strike the side of the receptacle 50 in which the column is placed, so as to permit a smooth layer to be placed within the receptacle by the fluid running down the inner side wall of that receptacle in a controlled manner.

Subsequent layers of subsequent fluids may be disposed within the receptacle 50 by transfer through the column 12 or 36, where a minimum momentum is provided to that fluid, by the dispersion of that fluid across the planar bottom member 22 and through the arcuate orifice 30 and onto an arcuate broad path within the receptacle 50. Thus, the fluid is permitted to layer with minimum turbulence and minimum manual input, once the column has been given the desired size or charge of fluid. Further manual operation to achieve drainage of fluid to be layered in the receptacle, is not necessary.

We claim:

1. A layering apparatus for the disposition of fluid into a layer into a receptacle in which said apparatus is placed, comprising;

a cylindrically shaped column member having an outer wall, said column having a lower or first end and an open upper or second end;

a base member arranged across said first end, said base member being disposed at a skewed angle with respect to the longitudinal axis of said column; and a size variable opening arranged through said wall of said column, at the juncture of said base member and said wall, to permit any fluid deposited in said upper end of said column to drain out said opening in said wall at said first end of said column in a controlled manner to permit layering of said fluid in said receptacle, said opening being variable in size by a movable panel arranged on said wall of said column against said opening.

2. The layering apparatus as recited in claim 1, wherein said base member is of planar configuration, to provide a flat surface from which fluid deposited in said column may drain.

3. The layering apparatus as recited in claim 1, wherein said opening in said wall of said column is of arcuate configuration.

4. The layering apparatus as recited in claim 3, wherein said arcuate opening in said wall subtends an arc of from about 20° to about 60° along a peripheral portion of said wall.

5. The layering apparatus as recited in claim 1, wherein said column has an annular flange arranged about its upper end to permit said column to rest against the upper end of a receptacle during drainage of fluid from said column in the layering process.

6. The layering apparatus as recited in claim 1, wherein said opening has a heightwise dimensional range of from about 2 mm to about 30 mm.

7. A method of layering fluids in a receptacle, comprising the steps of:

arranging an elongated cylindrically shaped wall to define a column;

placing said column in an upper end of said receptacle, said column having an open upper end and a lower end, said lower end having a base member arranged thereacross;

skewing the angle of said base member with respect to the longitudinal axis of said column;

placing an opening through said wall of said column at said lower end thereof;

depositing sequentially a plurality of fluids to be layered in said receptacle, in said upper end of said column so as to permit said fluid to flow through said column, over said base member and out of said column through said opening, to form a layer in said receptacle in a manner conducive to layering of fluid into said receptacle;

forming said base member to as to be planar, to allow any fluid deposited in said column to flow evenly thereacross and out through said opening in said wall of said column;

providing a radially outwardly directed flange around said upper end of said column, to permit said flange to rest upon an upper edge of said receptacle during a layering procedure therein;

forming said opening into an arcuate shape; and changing the size of said opening by moving a curvilinear panel against the inner side of said wall, to change the dimension of said opening.

8. A layering apparatus for the disposition of multiple fluids in sequence, into a receptacle, in a series of separate layers, said apparatus comprising:

a tubular shaped column having an open upper end and a lower end having a base plate arranged thereacross, said base plate arranged at an angle of between about 35° to 60° with respect to the longitudinal axis of said column;

an annular flange arranged about said upper end of said column to permit said column to be supported by an upper edge of a receptacle in which said column is disposed; and a size variable opening arranged in said column adjacent said base plate, to permit the even, controlled drainage of fluid into a receptacle after receipt of that fluid in said upper end of said column.

9. The layering apparatus as recited in claim 8, wherein said opening is of arcuate configuration, to permit flow of fluid directly from said base plate into said receptacle.

10. The layering apparatus as recited in claim 9, wherein said opening has a heightwise dimension in a range of about 3 mm to about 30 mm.

* * * * *